US007222854B2

(12) United States Patent
Sorge

(10) Patent No.: US 7,222,854 B2
(45) Date of Patent: May 29, 2007

(54) MODIFIED BLACKJACK GAME

(76) Inventor: Nicholas Sorge, 7 Susan Ct., Deer Park, NY (US) 11729

( * ) Notice: Subject to any disclaimer, the term of this patent is extended or adjusted under 35 U.S.C. 154(b) by 0 days.

(21) Appl. No.: 10/884,098

(22) Filed: Jul. 2, 2004

(65) Prior Publication Data

US 2005/0269774 A1 Dec. 8, 2005

Related U.S. Application Data

(63) Continuation-in-part of application No. 10/862,211, filed on Jun. 7, 2004.

(51) Int. Cl.
*A63F 1/00* (2006.01)

(52) U.S. Cl. ..... 273/292; 273/274; 463/12

(58) Field of Classification Search ..... 273/292, 273/309, 274; 463/12, 13
See application file for complete search history.

(56) References Cited

U.S. PATENT DOCUMENTS 4,861,041 A 8/1989 Jones et al.
5,529,309 A 6/1996 Bartlett
5,632,485 A * 5/1997 Woodland et al. ..... 273/292
5,636,838 A 6/1997 Caro
5,636,843 A * 6/1997 Roberts ..... 273/292
5,702,106 A 12/1997 Alvarez, Jr.
5,718,430 A 2/1998 Aramapakul et al.
5,743,532 A 4/1998 Lafferty
5,836,586 A 11/1998 Marks et al.
5,839,730 A 11/1998 Pike
5,845,907 A 12/1998 Wells
5,863,042 A 1/1999 Lo
5,934,675 A 8/1999 Handelman et al.
5,975,529 A 11/1999 de Keller
5,979,897 A 11/1999 Grossman
5,984,308 A 11/1999 Herrmann
6,000,699 A 12/1999 Long
6,012,719 A 1/2000 Webb
6,062,564 A * 5/2000 Terminel ..... 273/292
6,079,711 A 6/2000 Wei et al.
6,095,525 A 8/2000 Terminel
6,113,102 A 9/2000 Marks et al.

(Continued)

OTHER PUBLICATIONS

"Over/Under 13 Blackjack", Gaming Concepts, Inc., 1988.*

(Continued)

*Primary Examiner*—Benjamin Layno
(74) *Attorney, Agent, or Firm*—Scully, Scott, Murphy & Presser, P.C.

(57) ABSTRACT

A method for playing a modified blackjack game between a dealer and at least one player. Each player places an first wager, the outcome of which is determined by conventional rules of blackjack. Players may optionally place an additional wager corresponding to a predicted total point value or point value range of an initial hand of two cards dealt to the player. After the dealer has dealt a player placing an additional wager a second card from one or more standard decks of playing cards, an actual total point value is computed for the two-card hand of that player. If an actual total point value is equal to or in a range of a predicted total point value or range, a player placing an additional wager wins a predetermined multiple of an amount of the additional wager. A second predetermined multiple may be paid if a player's two card hand includes two cards of the same suit.

5 Claims, 4 Drawing Sheets

U.S. PATENT DOCUMENTS

| | | | |
|---|---|---|---|
| 6,158,741 | A | 12/2000 | Koelling |
| 6,206,375 | B1 | 3/2001 | Wichinsky |
| 6,227,969 | B1 | 5/2001 | Yoseloff |
| 6,341,778 | B1 | 1/2002 | Lee |
| 6,371,867 | B1 | 4/2002 | Webb |
| 6,386,973 | B1 | 5/2002 | Yoseloff |
| 6,394,456 | B1 | 5/2002 | Long |
| 6,422,565 | B1 | 7/2002 | Daines |
| 6,450,500 | B1 | 9/2002 | Miller |
| 6,481,717 | B1 | 11/2002 | Richardelle |
| 6,481,718 | B2 | 11/2002 | Koelling |
| 6,481,719 | B2 | 11/2002 | Webb |
| 6,485,020 | B1 | 11/2002 | Broadnax |
| 6,511,070 | B1 | 1/2003 | Daines |
| 6,523,831 | B2 | 2/2003 | Webb |
| 6,536,767 | B1 | 3/2003 | Keller |
| 6,543,773 | B2 | 4/2003 | Mims |
| 6,575,464 | B1 | 6/2003 | Fertitta et al. |
| 6,585,588 | B2 | 7/2003 | Hartl |
| 6,588,757 | B1 | 7/2003 | Lo |
| 6,659,461 | B2 | 12/2003 | Yoseloff et al. |
| 6,692,003 | B2 | 2/2004 | Potter et al. |
| 6,719,291 | B1 | 4/2004 | de Keller |
| 6,719,292 | B2 | 4/2004 | Lo |
| 6,749,200 | B2 | 6/2004 | Yurkins |
| 6,773,013 | B2 | 8/2004 | Caldwell |
| 6,776,416 | B1 | 8/2004 | Jackson |
| 6,789,800 | B2 | 9/2004 | Webb |
| 6,808,173 | B2 | 10/2004 | Snow |
| 6,830,247 | B2 | 12/2004 | Lo |
| 6,845,981 | B1 | 1/2005 | Ko |
| 6,854,731 | B2 | 2/2005 | Saucier |
| 6,854,733 | B2 | 2/2005 | Webb |
| 6,863,274 | B2 | 3/2005 | Webb |
| 6,874,786 | B2 | 4/2005 | Bruno et al. |
| 6,877,746 | B1 | 4/2005 | Herren et al. |
| 6,896,265 | B1 | 5/2005 | Schlumbrecht |
| 6,896,266 | B1 | 5/2005 | Terminel |
| 6,902,167 | B2 | 6/2005 | Webb |
| 6,916,245 | B1 | 7/2005 | Vancura et al. |
| 7,004,467 | B2 | 2/2006 | Lo |
| 7,025,354 | B1 | 4/2006 | Jones |
| 7,055,822 | B2 | 6/2006 | Lo |
| 2001/0015529 | A1 | 8/2001 | Allen |
| 2001/0035607 | A1 | 11/2001 | Moore |
| 2002/0027322 | A1 | 3/2002 | Breeding et al. |
| 2002/0036382 | A1 | 3/2002 | Brunelle |
| 2002/0190467 | A1 | 12/2002 | Braun |
| 2003/0057648 | A1 | 3/2003 | Webb |
| 2003/0155715 | A1 | 8/2003 | Walker et al. |
| 2003/0207706 | A1 | 11/2003 | Potter et al. |
| 2003/0218303 | A1 | 11/2003 | Walker et al. |
| 2003/0222400 | A1 | 12/2003 | Collins et al. |
| 2004/0124585 | A1 | 7/2004 | Daines |
| 2004/0132519 | A1 | 7/2004 | Holm |
| 2004/0195770 | A1 | 10/2004 | Ornstein |
| 2004/0227294 | A1 | 11/2004 | Au-Yeung |
| 2005/0029743 | A1 | 2/2005 | Daines |
| 2005/0035548 | A1 | 2/2005 | Yoseloff et al. |
| 2005/0040601 | A1 | 2/2005 | Yoseloff et al. |
| 2005/0073100 | A1 | 4/2005 | Falciglia, Sr. |
| 2005/0073102 | A1 | 4/2005 | Yoseloff et al. |
| 2005/0082760 | A1 | 4/2005 | Yoseloff et al. |
| 2005/0085287 | A1 | 4/2005 | Sines |
| 2005/0116414 | A1 | 6/2005 | Yurkins |
| 2005/0121854 | A1 | 6/2005 | Webb |
| 2005/0242506 | A1 | 11/2005 | Yoseloff |
| 2005/0253338 | A1 | 11/2005 | Daines |

OTHER PUBLICATIONS

Pamphlet: "Table Games", by Shuffle Master- Inc., Las Vegas, NV 2004 (copy enclosed).

* cited by examiner

MODIFIED BLACKJACK GAME

CROSS REFERENCE TO RELATED APPLICATIONS

This Application is a Continuation in Part Application of U.S. patent application Ser. No. 10/862,211, filed on Jun. 7, 2004, the disclosure of which is incorporated herein by reference.

BACKGROUND OF THE INVENTION

1. Field of the Invention

The invention relates generally to the field of casino gaming. More particularly, the invention relates to a variation or modification of the card game known as blackjack or twenty-one. The invention further relates to a card game wherein players place a wager which corresponds to a predicted total point value of two cards dealt to the player.

2. The Prior Art

Blackjack or twenty-one is a well-known casino card game. Blackjack is played with one or more standard decks of 52 playing cards. Typically, the game is played on a table having a straight edge behind which a dealer stands and a semi-circular edge around which one or more players are positioned. The maximum number of players at a table may be, for example, seven. The blackjack table may have a top surface covered with felt or another material which is imprinted with various indicia. These various indicia may include text describing basic and house rules of play and may indicate areas where players' cards are to be dealt and where players' bets are to be placed.

The object of blackjack is for a player to accumulate a hand of cards which has a point total exceeding that of the blackjack dealer, without exceeding twenty-one. Numbered cards have a point value which equals their number value. Face cards (kings, queens, and jacks) are assigned a point value of ten and aces are assigned a point value of either one or eleven as determined by the person holding the hand including one or more aces. A two-card hand having a point total of twenty-one is known as blackjack.

Blackjack play is commenced by a player making an initial wager or bet on the outcome of the upcoming hand. An amount of this initial bet, also known as an ante, may be regulated between a minimum and maximum amount set by the casino or house for the particular table of play. Players typically indicate their bet or wager by placing an appropriate number of chips or markers, each of which has a designated value or values assigned to it, in a designated area of the blackjack table.

Following the placing of bets or wagers, the dealer deals cards to each player and to himself or herself. Each player and the dealer are initially dealt two cards. Each of the players' cards is dealt face up. The dealer's initial two cards are typically dealt one face up and one face down. The dealer generally deals one card to each player in turn, starting from the dealer's left and proceeding to the dealer's right. The dealer then deals a card to himself or herself and proceeds to deal a second card to each player, again moving from left to right and to himself or herself.

After the dealer and the players have been dealt an initial hand of two cards, each player in turn elects to receive one or more additional cards ("hit") or to take no additional cards ("stand"). A player may elect to take additional cards until they decide to stand or until the point total of the player's hand exceeds twenty-one, known as "busting." Once all players have either received their desired number of cards or have busted, the dealer elects to take additional cards or to stand. Under most rules, a dealer is not permitted to receive additional cards if the dealer's existing hand has a total point value of seventeen or greater and a dealer is required to take an additional card if the dealer's existing hand has a point total of less than seventeen.

Once all of the players and the dealer have either received a desired number of cards or have busted, the outcome of the game is determined. A player wins if either the dealer's point total exceeds twenty-one (i.e. the dealer busts) or if the player's point total exceeds the dealer's point total for a particular hand. In either event, the winning player is paid an amount equal to his or her initial bet in addition to receiving his or her initial bet back. If the dealer's hand exceeds that of a player's or if a player busts, that player loses and forfeits his or her bet. If a dealer's point total for a hand equals that of a player, a tie or push is declared and that player receives his or her initial bet back.

The conventional game of blackjack described above has been supplemented with a number of alternative betting procedures, including insurance, doubling down, and splitting pairs. Additionally, various methods or procedures relating to variations on or modifications of a conventional blackjack game are disclosed in the following references, the disclosure of which is hereby incorporated by reference: U.S. Pat. No. 4,861,041 to Jones et al.; U.S. Pat. No. 5,836,586 to Marks et al.; U.S. Pat. No. 5,863,042 to Lo; U.S. Pat. No. 5,934,675 to Handelman et al.; U.S. Pat. No. 6,113,102 to Marks et al.; U.S. Pat. No. 6,394,456 to Long; U.S. Pat. No. 6,450,500 to Miller; U.S. Pat. No. 6,485,020 to Broadnax; U.S. Pat. No. 6,536,767 to Keller; U.S. Pat. No. 6,692,003 to Potter et al.; and U.S. Patent Publication Nos. 2003/0222400 to Collins et al.; 2003/0218303 to Walker et al.; and 2003/0057648 to Webb.

SUMMARY OF THE INVENTION

The invention relates to a variation on or modification of the game of blackjack or twenty-one which can be based on any blackjack or twenty-one game. The invention also relates to a discrete card game wherein a player places a wager which corresponds to a predicted total point value of a two-card hand dealt to the player.

In a method according to an embodiment of the invention, a modified blackjack game is played between at least one player and a dealer using at least one standard deck of playing cards. Each player places a first wager in order to become eligible to participate in the blackjack game. The outcome of the first wager is determined in accordance with conventional rules of a blackjack play and is dependant upon the final hands of cards drawn by the dealer and the individual player placing the first wager.

Each player may optionally place an additional wager or side bet. The additional wager corresponds to a predicted total point value of an initial hand of two cards dealt to a player placing an additional wager. An initial hand of two cards is dealt to each player who has placed a first wager and to the dealer. An actual total point value is determined for the initial hand of two cards dealt to each player placing an additional wager. The actual total point value of the two-card hand is compared to the predicted total point value for a player placing an additional wager. If the actual total point value is equal to the predicted total point value, the player making the additional wager is paid a predetermined multiple of an amount of the additional wager. A predetermined multiple of an amount of an additional wager may comprise one multiple when an actual total point value is equal to a predicted total point value and another multiple when an actual total point value is equal to a predicted total point value and the two card hand comprises two cards of the same suit. If the actual total point value is not equal to the predicted total point value, the dealer collects an amount of the additional wager from the player making the additional wager.

The blackjack game is completed according to conventional rules of play.

In a method according to an embodiment of the invention, a player electing to place an additional wager may select a predicted total point value of an initial hand of two cards from all possible total point values of two cards. A player placing an additional bet may indicate a predicted total point value of an initial two-card hand by placing one or more wagering devices in a designated area of a blackjack table. Such designated area may include a plurality of zones, each zone indicating a possible total point value of two cards. A zone of the designated area may indicate individual two card total point values or, alternatively, one or more zones may include a plurality of two card total point values grouped together.

In a method according to an embodiment of the invention, an additional wager may be placed prior to any cards being dealt and an outcome of an additional wager is determined and settled immediately after a player who has elected to place an additional wager receives a second card and before a succeeding player or the dealer receives a second card. An amount of an additional wager may be regulated between a minimum and maximum value and an outcome of an additional wager may be independent of an outcome of a first wager. The placing of an additional wager may be optional, with a player placing a first wager electing or declining to place an additional wager.

In a further embodiment according to the invention, a card game may be played between at least one player and a dealer. A player places a wager corresponding to a predicted total point value of a hand of two cards to be dealt to a player. The wager is placed in a manner as described herein for an additional wager placed in a modified blackjack game. A dealer deals two cards to a player from one or more standard decks of playing cards. An actual total point value for a player's two-card hand is computed and compared to a predicted total point value. If an actual total point value is equal to a predicted total point value, the player wins and is paid a predetermined multiple of an amount of the winning player's wager. If an actual total point value for a player's two-card hand is not equal to a predicted total point value, a player forfeits an amount of the wager placed.

An advantage of a modified blackjack game according to an embodiment of the invention is that a player is given an option to place an additional wager corresponding to a predicted total point value of the first two cards dealt to that player, wherein the option to place an additional wager increases player interest and casino revenue. A game according to an embodiment of the invention may be based on any blackjack or twenty-one game. Other advantages of a modified blackjack game according to an embodiment of the invention are that the modified game is simple to learn and play and that the outcome of an additional wager is independent of an outcome of a first wager, thereby providing a player with increased possibilities for winning in a particular game. A further advantage of a modified blackjack game according to an embodiment of the invention is that a player choosing to make an additional wager may select a predicted total point value of an initial hand of two cards from all possible total point values of two cards.

BRIEF DESCRIPTION OF THE DRAWINGS

Other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements.

DETAILED DESCRIPTION OF THE PREFERRED EMBODIMENTS

Figure 1:
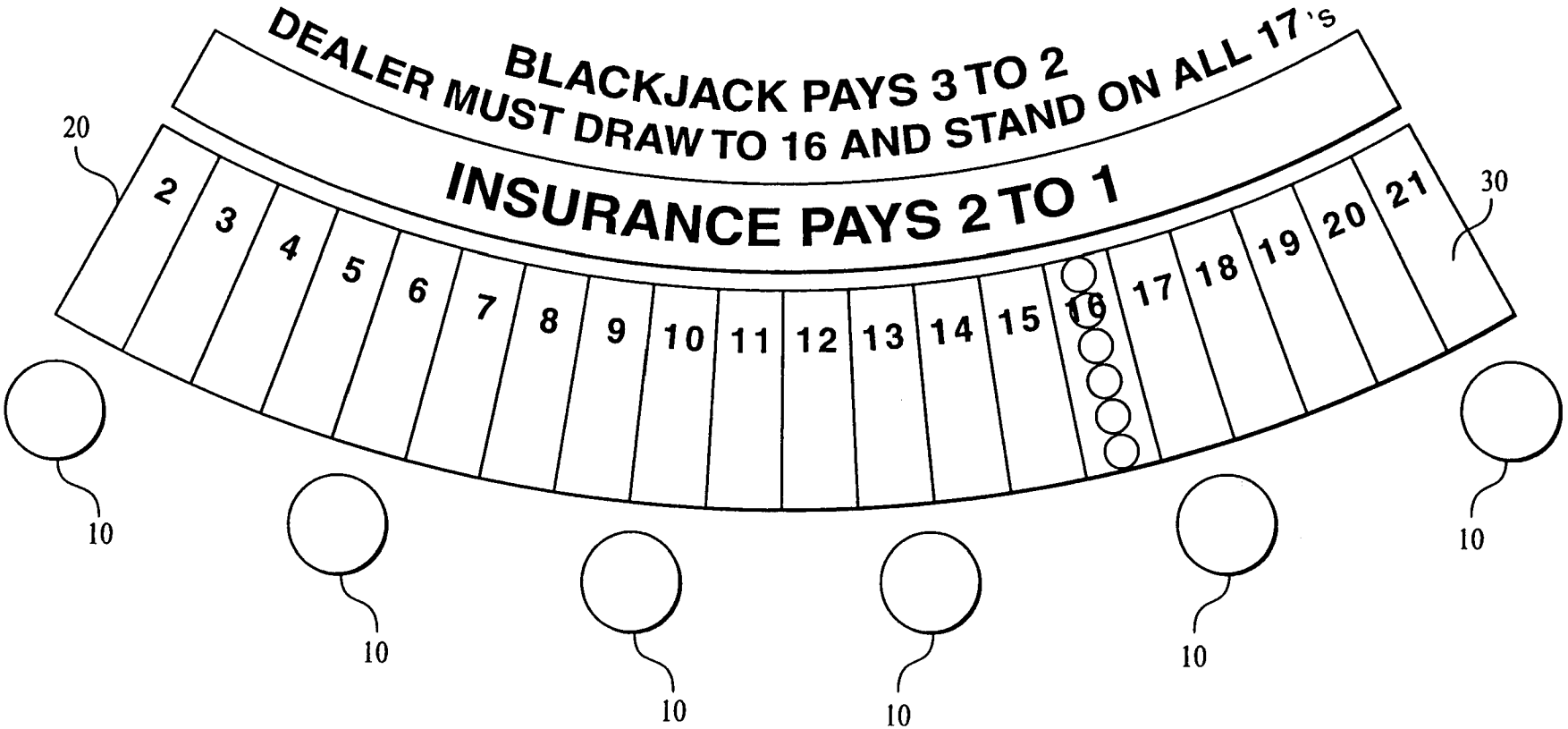
FIG. 1 shows a top view of a playing surface which can be used to play a modified blackjack game according to an embodiment of the invention.

Referring now in detail to the drawing, FIG. 1 shows a top view of a top surface of a blackjack table which can be used to play a modified blackjack game according to an embodiment of the invention.

One or more players, for example six players, sit or stand adjacent to a front, semi-circular portion of a blackjack table. A dealer is positioned behind a back edge of the table, facing the one or more players.

One or more first wager locations 10 are provided for players to make a first wager in order to be eligible to participate in a particular game or round of play. A player may indicate a first wager by placing one or more chips, markers, or other wagering devices in a first wager location 10 associated with that player. Each chip or marker may have a predetermined value. The amount of a first wager which a player may make for a particular game or table may be regulated between certain maximum and minimum values by a casino or other authority. An outcome of each player's first wager is determined at the conclusion of a particular game in accordance with conventional rules of blackjack play by comparing a player's final hand total point value to a dealer's final hand total point value.

One or more additional wager locations 20 are provided for players to make an additional wager which corresponds to a predicted total point value of an initial hand of two cards dealt to a player making an additional wager. The placing of an additional wager may be optional, and a player may elect not to place an additional wager in a particular game or round of play and still participate in that particular game or round of play provided the player has made a first wager.

Additional wager locations 20 may comprise a plurality of zones 30, wherein each individual zone indicates a possible total point value of two cards. Individual zones 30 may, for example, include all possible total point values of two cards, i.e. 2, 3, 4, 5, 6, 7, 8, 9, 10, 11, 12, 13, 14, 15, 16, 17, 18, 19, 20 and 21 or Blackjack.

A player electing to make an additional wager may indicate an additional wager by placing one or more wagering devices, such as chips or markers, within a zone 30 of additional wager location 20 which corresponds to a predicted total point value of an initial hand of two cards dealt to the player electing to make an additional wager. For example, a player who hopes a total point value on an initial two cards dealt to him or her will total eleven, may place one or more wagering devices in an area or zone 30 of additional wager location 20 demarked "11". Each player electing to place an additional wager may place their one or more wagering devices in a pre-determined section or region within an individual zone 30 and/or the dealer may re-position one or more wagering devices within an individual zone. A position of one or more wagering devices within an individual zone 30 corresponds to a particular player position at a table. In this way, a dealer and/or player can associate a particular additional wager with a corresponding player making the additional wager. The amount of an additional wager which a player may place for a particular game or table may be regulated between certain maximum and minimum values by a casino or other authority.

Following the placing of first and additional wagers, a dealer deals a card to each player who has made a first wager in succession from left to right and a card to the dealer himself or herself. Next, the dealer deals a second card to each player who has received a first card and to the dealer himself or herself. Cards may be dealt from one or more standard decks of 52 cards, preferably from six to eight standard decks. Each card dealt to a player is dealt face up. After a player electing to make an additional bet has received a second card, and prior to any succeeding player or the dealer receiving a second card, a two-card total point value is computed for that player. An outcome of an additional bet is determined and settled after a player receives a second card and prior to any succeeding player or the dealer receiving a second card. In this way, all additional player bets are settled prior to the dealer receiving a second card.

An actual total point value is computed by adding the point values of the two cards initially dealt to a player who has made an additional wager. Card point values are assigned as in conventional blackjack play with numbered cards (2, 3, 4, 5, 6, 7, 8, 9, 10) of the various suits being assigned a point value equal to their numerical value and face cards (kings, queens, and jacks) of the various suits being assigned a point value of ten.

Aces are assigned a point value of either one or eleven at the discretion of a player holding a hand including an ace. An exception exists if a player draws a two-card hand consisting of an ace and any ten-point card, (10 or face card). This hand is a blackjack hand and the ace is assigned a point value of eleven, so that the total point value of the hand equals twenty one. A player drawing a blackjack hand cannot count an ace as one point. An ace may count as two different values if a player makes multiple additional or side bets. For example, if a player bets on six and sixteen and draws a two card had comprising a five and an ace, the player would win both bets because the hand could be scored as both a six and a sixteen. The exception for a blackjack still applies. Thus, if a player bets on eleven and draws an ace and a jack, for example, the ace must count as eleven and cannot be counted as one for the additional wager.

An actual total point value is compared to a predicted total point value for any player who has placed an additional wager. If an actual total point value is not equal to a predicted total point value, a player forfeits an amount equal to that player's additional wager and a dealer may collect the one or more wagering devices placed by that player as an additional wager.

If an actual total point value is equal to a predicted total point value, a player wins their additional wager and may be paid a predetermined multiple of an amount of that player's additional wager. For example, a player whose actual total point value for an initial two-card hand equals the player's predicted total point value may be paid a multiple of an amount of an additional wager according to the ratios in the following chart:

TABLE 1

| TOTAL POINT VALUE OF INITIAL TWO-CARD HAND | PAYS AMOUNT PAID-AMOUNT WAGERED |
|---|---|
| 2 | 165-1 |
| 3 | 78-1 |
| 4 | 53-1 |
| 5 | 39-1 |
| 6 | 31-1 |
| 7 | 25-1 |
| 8 | 22-1 |
| 9 | 19-1 |
| 10 | 16-1 |
| 11 | 19-1 |
| 12 | 9-1 |
| 13 | 9-1 |
| 14 | 9-1 |
| 15 | 10-1 |
| 16 | 11-1 |
| 17 | 12-1 |
| 18 | 13-1 |
| 19 | 15-1 |
| 20 | 8-1 |
| 21/Blackjack | 19-1 |

The payout ratios for an additional wager can be adjusted by an individual casino or other authority. After any additional wagers are settled, a game may be completed according to conventional rules of blackjack play. An outcome of an additional wager or side bet may be independent of a final total point value of either a player or a dealer's hand and independent of an outcome of a player's first wager.

Figure 2:
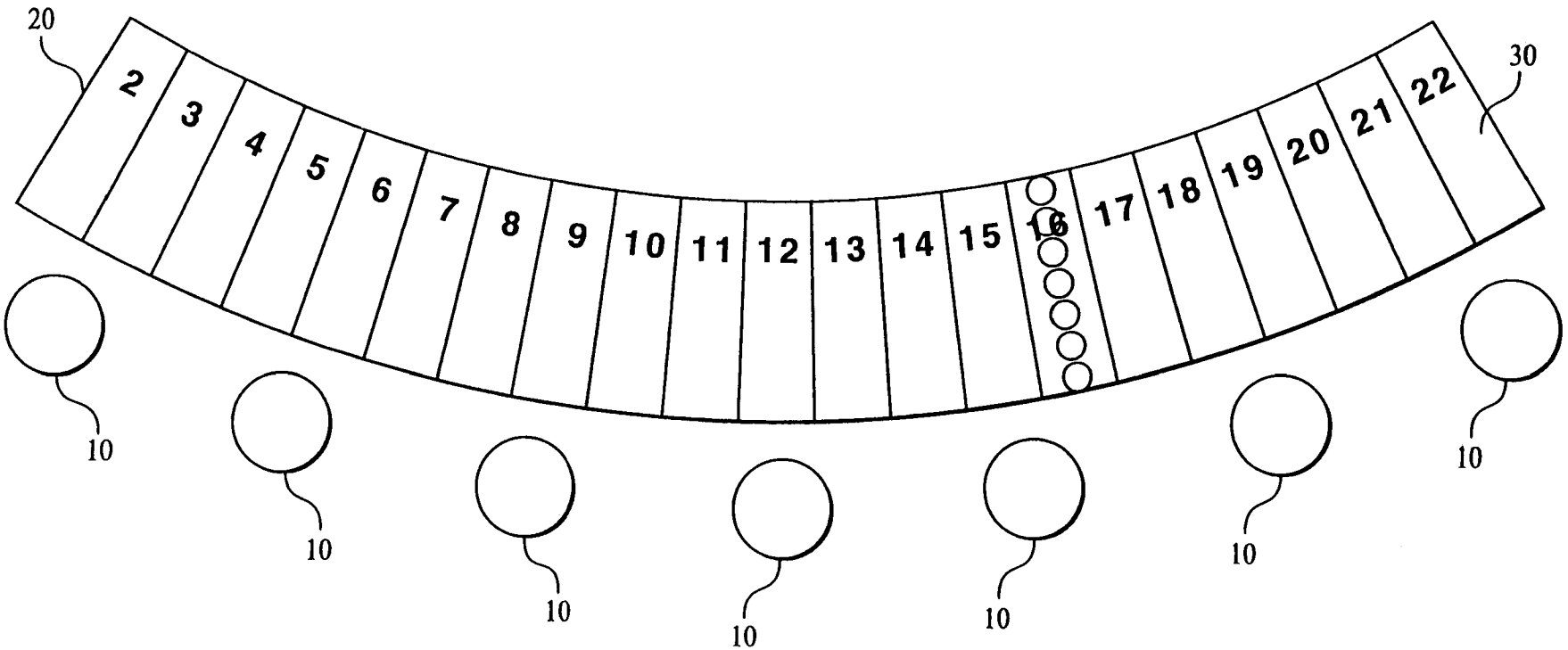
FIG. 2 shows a top view of a playing surface which can be used to play a card game according to another embodiment of the invention.

FIG. 2 shows a playing surface which can be used to play a card game according to a further embodiment of the invention. In this embodiment, a discrete card game may be played between at least one player and a dealer using at least one standard deck of 52 playing cards.

As shown in FIG. 2, seven wager locations 10 may be provided to accommodate seven players. The game is played in a manner similar to the method described above, except no first wager is made and the game is not played in conjunction with blackjack or 21.

In a game according to this embodiment, a player drawing a two-card hand including an ace and a ten point card may count the ace as either a one (for a total hand point value of eleven) or as an eleven (for a total hand point value of twenty-one). An additional zone demarked "22" is provided as a total point value of twenty-two is possible in this embodiment when a player draws two aces.

A player may place a wager corresponding to a predicted total point value of a two-card hand by placing one or more wagering devices, such as chips or markers, in a designated zone of a table or playing surface corresponding to a predicted total point value. A dealer deals two cards to a player. An actual total point value is calculated for a player's two-card hand and compared to a predicted total point value. If actual and predicted total point values are equal, a player is paid a pre-determined multiple of an amount of their wager. If actual and predicted point values are not equal, a player forfeits an amount of their wager. This game is a stand-alone card game not played in conjunction with blackjack or twenty-one.

Figure 3:
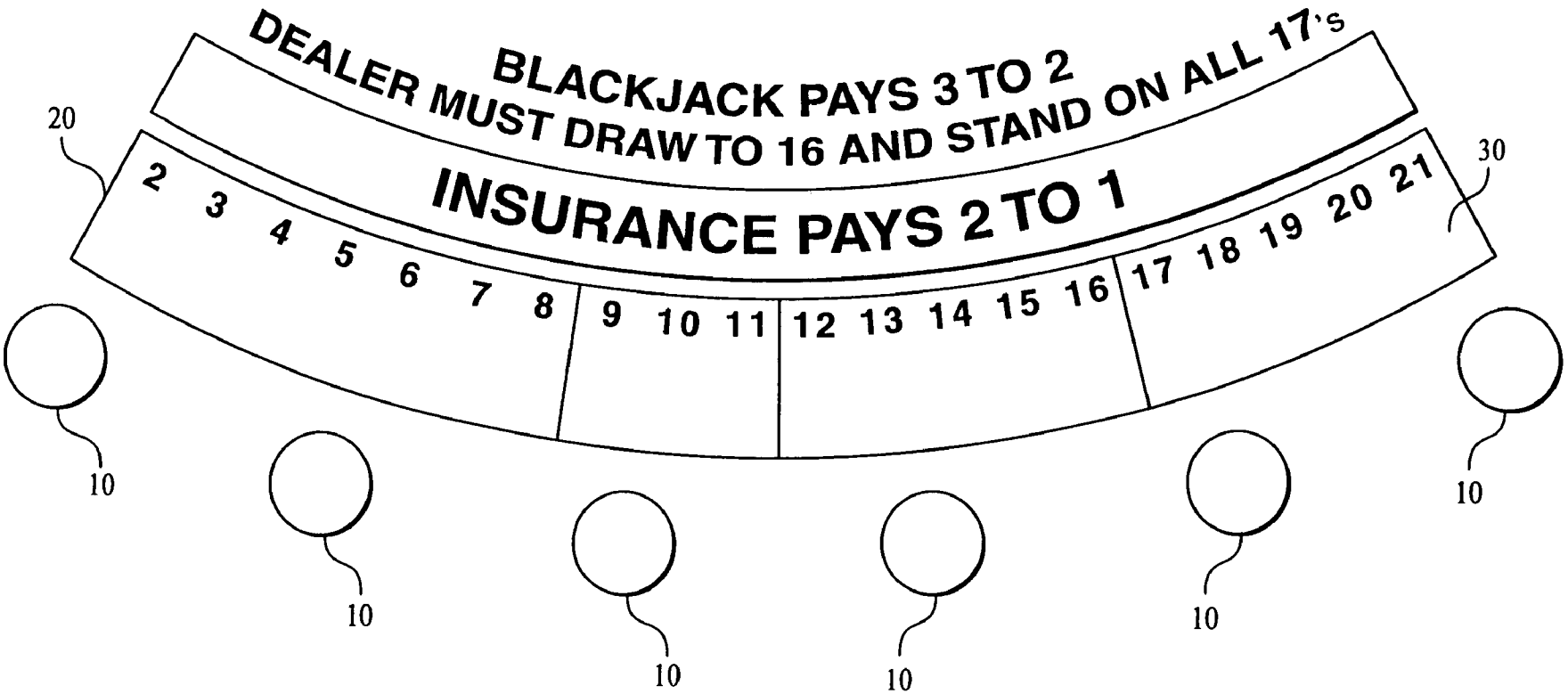
FIG. 3 shows a top view of a playing surface which can be used to play a modified blackjack game according to another embodiment of the invention.

FIG. 3 shows a top view of a top surface of a blackjack table which can be used to play a modified blackjack game according to another embodiment of the invention. As shown in FIG. 3, additional wager location 20 may comprise a plurality of zones 30, wherein individual zones 30 may indicate one or more possible total point values of two cards. For example, as shown in FIG. 3, one zone 30 may include total point values 2, 3, 4, 5, 6, 7 and 8; another zone 30 may include total point values 9, 10 and 11; another zone 30 may include total point values 12, 13, 14, 15 and 16 and another zone 30 may include total point values 17, 18, 19, 20 and 21. In this way a player may indicate an additional wager by placing one or more wagering devices, such as chips or markers, within a zone 30 of additional wager location 20 which includes a predicted total point value of an initial hand of two cards dealt to the player. If the zone in which the player has placed one or more wagering devices includes the actual two card point total dealt to that player, the player wins and is payed a pre-determined multiple of the wager amount. Each zone 30 may have associated therewith a particular winning payout ratio, which may be set or regulated by a casino or other authority.

Figure 4:
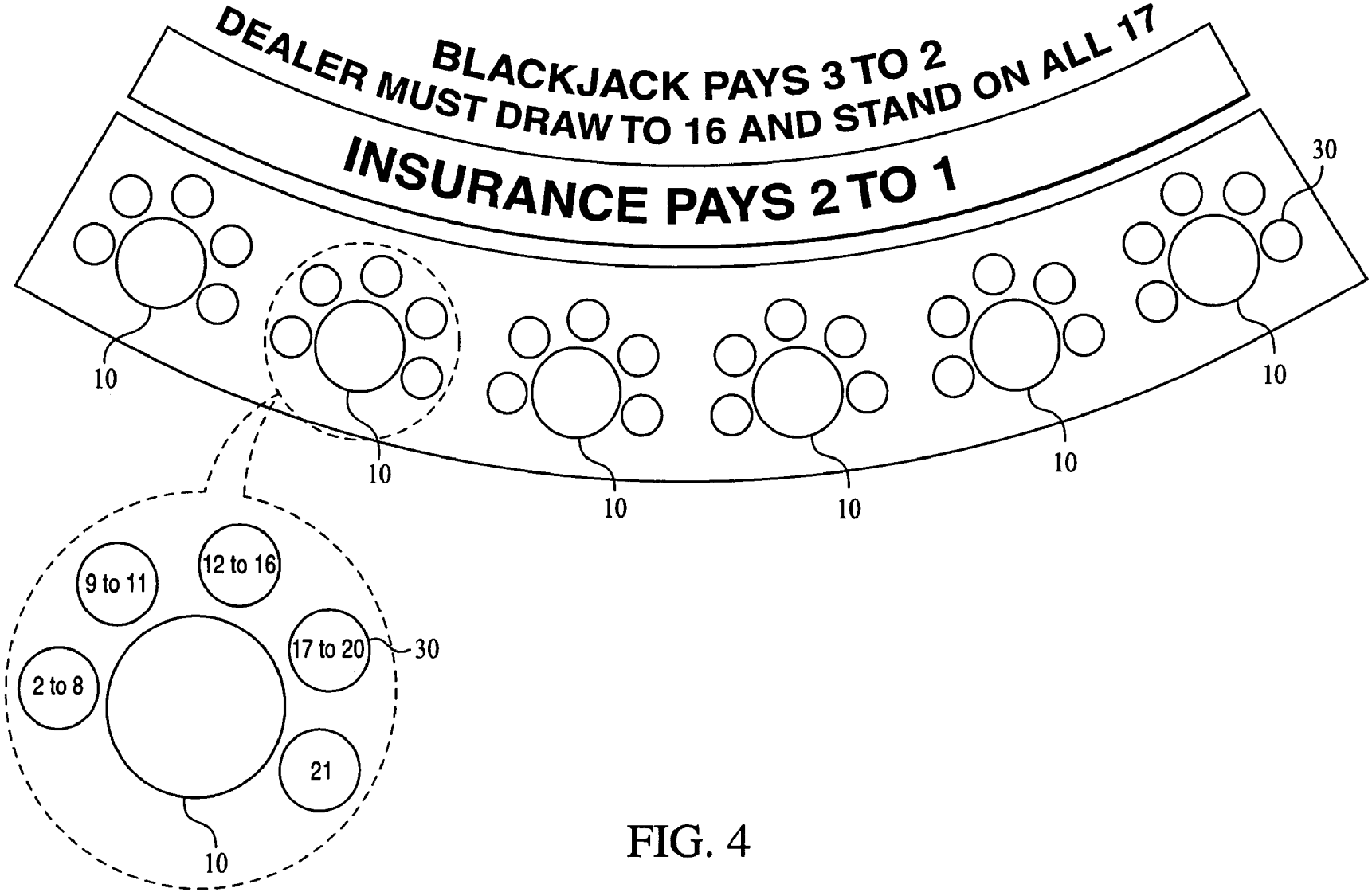
FIG. 4 shows a top view of a playing surface which can be used to play a modified blackjack game according to another embodiment of the invention.

FIG. 4 shows a top view of a top surface of a blackjack table which can be used to play a modified blackjack game according to another embodiment of the invention. As shown in FIG. 4, a plurality of zones 30 may be provided for each player to indicate an additional wager. Additional wager zones 30 may be disposed in proximity to first wager location 10 for each player. An additional wager zone may indicate one or more possible two card total point values. For example, as shown in FIG. 4, five additional wager zones 30 may be located in proximity to each first wager location 10, with a first additional wager zone marked "2 to 8", a second additional wager zone marked "9 to 11", a third additional wager zone marked "12 to 16", a fourth additional wager zone marked "17 to 20" and a fifth additional wager zone marked "21".

A player may indicate an additional wager by placing one or more wagering devices, such as chips or markers, within a zone 30 in proximity to that player's first wager location which includes a predicted total point value of an initial hand of two cards dealt to the player. If the zone 30 in which the player has placed one or more wagering devices includes the actual two card point total dealt to that player, the player wins and is payed a pre-determined multiple of the wager amount.

Each zone 30 may have associated therewith a particular winning payout ratio or predetermined multiple of a wager amount, which may be set or regulated by a casino or other authority. Additionally, each zone 30 may have associated therewith a plurality of winning payout ratios.

For example, each zone 30 may have associated with it a first payout ratio which applies when a total point value of a player's initial two card hand is equal to or within a range indicated by a zone 30 in which a player has placed an additional wager. Each zone 30 may also have associated with it a second payout ratio which applies when, in addition to a total point value of a player's initial two card hand being equal to or within a range indicated by a zone 30, that player's two card hand comprises two cards of the same suit. The second payout ratio, which applies when a player has correctly predicted a total point value of an initial two card hand and that player's two card hand comprises a single suit, e.g. two spades, two clubs, two hearts or two diamonds, may be greater than a first payout ratio. All payout ratios may be adjusted, set or regulated by a casino or other authority.

For example, a player whose actual total point value for an initial two-card hand equals or is within a range of the player's predicted total point value and who draws an initial two card hand wherein both cards are of the same suit may be paid a multiple of an amount of an additional wager according to the ratios in the following chart:

TABLE 2

| PREDICTED TWO-CARD TOTAL POINT VALUE OR RANGE | PAYS AMOUNT PAID-AMOUNT WAGERED (Actual two-card total point value equal to or in range of predicted) | PAYS AMOUNT PAID-AMOUNT WAGERED (Actual two-card total point value equal to or in range of predicted AND two cards are same suit) |
|---|---|---|
| 2–8 | 4-1 | 7-1 |
| 9–11 | 4-1 | 10-1 |
| 12–16 | 1-1 | 3-2 |
| 17–20 | 2-1 | 3-1 |
| 21 | 15-1 | 32-1 |

Accordingly, while several embodiments of the present invention have been shown and described, it is obvious that many changes and modifications may be made thereunto without departing from the spirit and scope of the invention.

What is claimed is:

1. A method for playing a modified blackjack game between at least one player and a dealer, using at least one standard deck of playing cards, the method comprising the steps of:

a) having at least one player place a first wager to participate in the blackjack game, wherein an outcome of said first wager is determined by conventional rules of play;

b) providing at least three additional wager zones disposed in a vicinity of each player, wherein each of said at least three additional wager zones has a predetermined multiple associated therewith and wherein a first predetermined multiple associated with one of said at least three additional wager zones is different from a second predetermined multiple associated with another of said at least three additional wager zones, and wherewith each of said at least three additional wager zones indicates a possible total point value of two cards or a range of possible total point values of two cards, wherein said total point value is computed by adding an individual point value of each of a first card and a second card dealt to a player;

c) having at least one player place an additional wager by placing one or more wagering devices in one or more of said at least three additional wager zones corresponding to a predicted total point value or predicted total point value range of an initial hand of two cards dealt to the player placing said additional wager;

d) dealing a first card to each player and to the dealer;

e) dealing a second card to each player;

f) determining an actual total point value of said initial hand of two cards dealt to the player placing said additional wager by adding the individual point values of each of said first card and said second card dealt to the player and comparing said actual total point value to said predicted total point value or said predicted total point value range, wherein for a purpose of determining said actual total point value, an ace may be assigned a point value of one, eleven or both at the discretion of the player placing said additional wager;

g) collecting an amount of said additional wager if said actual total point value is not equal to or in a range of said predicted total point value or said predicted total point value range;

(h) paying a predetermined multiple of said amount of said additional wager associated with the respective additional wager zone if said actual total point value is equal to or in a range of said predicted total point value or said predicted total point value range;

i) dealing a second card to the dealer; and j) completing the blackjack game according to conventional rules of play.

2. A method for playing a modified blackjack game between at least one player and a dealer, using at least one standard deck of playing cards, the method comprising the steps of:

a) having at least one player place a first wager to participate in the blackjack game, wherein an outcome of said first wager is determined by conventional rules of play;

b) providing five additional wager zones in the vicinity of each player, wherein each of said five additional wager zones has a predetermined multiple associated therewith and wherein a first predetermined multiple associated with one of said five additional wager zones is different from a second predetermined multiple associated with another of said five additional wager zones, and wherein a first additional wager zone indicates a total point value range of 2 to 8, a second additional wager zone indicates a total point value range of 9 to 11, a third additional wager zone indicates a total point value range of 12 to 16, a fourth additional wager zone indicates a total point value range of 17 to 20 and a fifth additional wager zone indicates a total point value of 21, wherein said total point value is computed by adding an individual point value of each of a first card and a second card dealt to a player;

c) having at least one player place an additional wager by placing one or more wagering devices in one or more of said additional wager zones corresponding to a predicted total point value or predicted total point value range of an initial hand of two cards dealt to the player placing said additional wager;

d) dealing a first card to each player and to the dealer;

e) dealing a second card to each player;

f) determining an actual total point value of said initial hand of two cards dealt to the player placing said additional wager by adding the individual point values of each of said first card and said second card dealt to the player and comparing said actual total point value to said predicted total point value or said predicted total point value range, wherein for a purpose of determining said actual total point value, an ace may he assigned a point value of one, eleven or both at the discretion of the player placing said additional wager;

g) collecting an amount of said additional wager if said actual total point value is not equal to or in a range of said predicted total point value or said predicted total point value range;

(h) paying the predetermined multiple of said amount of said additional wager associated with the respective additional wager zone if said actual total point value is equal to or in a range of said predicted total point value or said predicted total point value range;

i) dealing a second card to the dealer; and j) completing the blackjack game according to conventional rules of play.

3. A method for playing a modified blackjack game between at least one player and a dealer, using at least one standard deck of playing cards, the method comprising the steps of:

a) having at least one player place a first wager to participate in the blackjack game, wherein an outcome of said first wager is determined by conventional rules of play;

b) providing at least three additional wager zones disposed in a vicinity of each player, wherein each of said at least three additional wager zones has a predetermined multiple associated therewith and one predetermined multiple associated with one of said at least three additional wager zones is different from another predetermined multiple associated with another of said at least three additional wager zones and wherein each of said at least three additional wager zones indicates a possible total point value, of two cards or a range of possible total point values of two cards wherein said total point value is computed by adding an individual point value of each of a first card and a second card dealt to a player;

c) having at least one player place an additional wager by placing one or more wagering devices in one or more of said at least three additional wager zones corresponding to a predicted total point value or predicted total point value range of an initial hand of two cards dealt to the player placing said additional wager;

d) dealing a first card to each player and to the dealer;

e) dealing a second card to each player;

f) determining an actual total point value of said initial hand of two cards dealt to the player placing said additional wager by adding the individual point values of each of said first card and said second card dealt to the player and comparing said actual total point value to said predicted total point value or said predicted total point value range, wherein for a purpose of determining said actual total point value, an ace may be assigned a point value of one, eleven or both at the discretion of the player placing said additional wager;

g) collecting an amount of said additional wager if said actual total point value is not equal to or in a range of said predicted total point value or said predicted total point value range;

(h) paying a first predetermined multiple of said amount of said additional wager associated with the respective additional wager zone if said actual total point value is equal to or in a range of said predicted total point value or said predicted total point value range and paying a second predetermined multiple of said amount of said additional wager associated with the respective additional wager zone if said actual total point value is equal to or in a range of said predicted total point value or said predicted total point value range and said initial hand of two cards dealt to the player placing said additional wager comprise a same suit;

i) dealing a second card to the dealer; and j) completing the blackjack game according to conventional rules of play.

4. The method according to claim 3, wherein said second predetermined multiple is greater than said first predetermined multiple.

5. A method for playing a modified blackjack game between at least one player and a dealer, using at least one standard deck of playing cards, the method comprising the steps of:

a) having at least one player place a first wager to participate in the blackjack game, wherein an outcome of said first wager is determined by conventional rules of play;

b) providing a plurality of additional wager zones disposed in a vicinity of each player, wherein each of said plurality of additional wager zones indicates a possible total point value of two cards or a range of possible total point values of two cards;

c) having at least one player place an additional wager by placing one or more wagering devices in one or more of said plurality of additional wager zones corresponding to a predicted total point value or predicted total point value range of an initial hand of two cards dealt to the player placing said additional wager;

d) dealing a first card to each player and to the dealer;

e) dealing a second card to each player;

f) determining an actual total point value of said initial hand of two cards dealt to the player placing said additional wager and comparing said actual total point value to said predicted total point value or said predicted total point value range, wherein for a purpose of determining said actual total point value, an ace may be assigned a point value of one, eleven or both at the discretion of the player placing said additional wager;

g) collecting an amount of said additional wager if said actual total point value is not equal to or in a range of said predicted total point value or said predicted total point value range;

h) paying a predetermined multiple of said amount of said additional wager if said actual total point value is equal to or in a range of said predicted total point value or said predicted total point value range;

i) dealing a second card to the dealer; and j) completing the blackjack game according to conventional rules of play.

* * * * *